US008978166B2

(12) United States Patent
Huang

(10) Patent No.: US 8,978,166 B2
(45) Date of Patent: Mar. 17, 2015

(54) MULTI-FUNCTION GARMENT

(75) Inventor: Deng-Shan Huang, Kaohsiung (TW)

(73) Assignee: Well & David Corp., Kaohsiung (TW)

( * ) Notice: Subject to any disclaimer, the term of this patent is extended or adjusted under 35 U.S.C. 154(b) by 344 days.

(21) Appl. No.: 13/595,006

(22) Filed: Aug. 27, 2012

(65) Prior Publication Data

US 2014/0053310 A1 Feb. 27, 2014

(51) Int. Cl.

| | |
|---|---|
| ***A41D 27/20*** | (2006.01) |
| ***A41D 3/00*** | (2006.01) |
| *A41D 27/02* | (2006.01) |
| *A41D 15/00* | (2006.01) |

(52) U.S. Cl.

CPC . *A41D 3/00* (2013.01); *A41D 15/00* (2013.01); *A41D 2400/422* (2013.01)

USPC ..... 2/250; 2/94; 2/108; 2/247

(58) Field of Classification Search

USPC ..... 2/69, 93, 94, 85, 102, 108, 247, 250; 5/636, 639, 652; 600/388, 300, 389

See application file for complete search history.

(56) References Cited

U.S. PATENT DOCUMENTS

| | | | | | |
|---|---|---|---|---|---|
| 2,292,347 | A | * | 8/1942 | Bailey | 2/93 |
| 2,825,902 | A | * | 3/1958 | Breier | 2/93 |
| 4,404,687 | A | * | 9/1983 | Hager | 2/94 |
| 4,404,689 | A | * | 9/1983 | DeWan | 2/247 |
| 4,700,409 | A | * | 10/1987 | De Lott | 2/94 |
| 5,787,504 | A | * | 8/1998 | Wu | 2/93 |
| 5,794,264 | A | * | 8/1998 | Yuen | 2/93 |
| 5,850,634 | A | * | 12/1998 | Toombs | 2/93 |
| D414,013 | S | * | 9/1999 | Group | D2/828 |
| 6,405,377 | B1 | * | 6/2002 | Davis | 2/94 |
| 6,532,611 | B1 | * | 3/2003 | Day | 5/636 |
| 6,598,248 | B1 | * | 7/2003 | Ong | 5/636 |
| 7,559,902 | B2 | * | 7/2009 | Ting et al. | 600/529 |
| 7,657,954 | B1 | * | 2/2010 | Bunkers | 5/644 |
| D626,725 | S | * | 11/2010 | Snyder et al. | D2/831 |
| 8,424,114 | B2 | * | 4/2013 | Snyder et al. | 2/86 |
| 8,801,577 | B2 | * | 8/2014 | Dibenedetto et al. | 482/8 |
| 8,818,478 | B2 | * | 8/2014 | Scheffler et al. | 600/388 |
| 2005/0054941 | A1 | * | 3/2005 | Ting et al. | 600/529 |
| 2006/0000004 | A1 | * | 1/2006 | Elen | 2/108 |
| 2008/0294019 | A1 | * | 11/2008 | Tran | 600/301 |
| 2009/0205096 | A1 | * | 8/2009 | Seemann | 2/4 |
| 2009/0241235 | A1 | * | 10/2009 | Weinreb | 2/84 |
| 2010/0041974 | A1 | * | 2/2010 | Ting et al. | 600/388 |
| 2010/0043117 | A1 | * | 2/2010 | Hildebrandt | 2/84 |

(Continued)

*Primary Examiner* — Gloria Hale

(74) *Attorney, Agent, or Firm* — Alan D. Kamrath; Kamrath IP Lawfirm, P.A.

(57) ABSTRACT

A multi-function garment includes an article of clothing and pockets disposed thereon. Each pocket includes an opening, a lining, and a two-sided engaging unit. The lining of one pocket includes a storage body of a ring-like configuration. The storage body has an open external vacancy interrupting the ring-like configuration of the storage body and an inner vacancy having one end closed and the other end communicating with the external vacancy. A dimension of the external vacancy is smaller than a dimension of the inner vacancy, and a protecting layer is disposed on an inner surface of the lining. Besides a wearing function of sheltering users' skin, the interior of the lining can be reversed outward to allow the article of clothing to be stuffed into the storage body, which is then converted into a neck pillow configuration for achieving the multiple function of using. The structure of the garment is also compact and easy to carry.

9 Claims, 10 Drawing Sheets

(56) References Cited

U.S. PATENT DOCUMENTS

| | | | | |
|---|---|---|---|---|
| 2010/0095356 | A1* | 4/2010 | Han et al. | 726/4 |
| 2010/0255099 | A1* | 10/2010 | Kim et al. | 424/487 |
| 2010/0292599 | A1* | 11/2010 | Oleson et al. | 600/519 |
| 2010/0313328 | A1* | 12/2010 | Shelton et al. | 2/102 |
| 2011/0235311 | A1* | 9/2011 | Stone | 362/106 |
| 2012/0099299 | A1* | 4/2012 | Gorson | 362/103 |
| 2012/0246795 | A1* | 10/2012 | Scheffler et al. | 2/69 |
| 2012/0330109 | A1* | 12/2012 | Tran | 600/301 |
| 2013/0067631 | A1* | 3/2013 | Crye | 2/85 |
| 2013/0077289 | A1* | 3/2013 | Gridley | 362/103 |
| 2013/0125312 | A1* | 5/2013 | Harooni | 5/639 |
| 2013/0162427 | A1* | 6/2013 | Dibenedetto et al. | 340/539.12 |
| 2013/0219624 | A1* | 8/2013 | Soffer et al. | 5/636 |
| 2013/0228185 | A1* | 9/2013 | Middlehurst et al. | 128/871 |
| 2014/0151416 | A1* | 6/2014 | Ishihara et al. | 224/182 |
| 2014/0249429 | A1* | 9/2014 | Tran | 600/483 |
| 2014/0285355 | A1* | 9/2014 | Matte et al. | 340/815.45 |

* cited by examiner

MULTI-FUNCTION GARMENT

BACKGROUND OF THE INVENTION

1. Field of the Invention

The present invention relates to a garment and, particularly, to a multi-function garment.

2. Description of the Related Art

Referring to FIGS. 1 and 2, a conventional convertible jacket 1 is commonly seen in the market. The convertible jacket 1 comprises an article of clothing 11, and a pocket 12 disposed on the article of clothing 11. The pocket 12 includes an opening 121 defined on the clothing 11, and a zipper 122 is disposed around the opening 121. In using, users can wear the jacket 1 as a garment. In another purpose, users can reverse the jacket 1 via the opening 121 to store the clothing 11 in the pocket 12. After zipping, a bag of a packed article of clothing 11 is presented (not shown).

In practice, the article of clothing 11 of the convertible jacket 1 is simply packed in the pocket 12. Namely, although it is convenient that the jacket 1 can be packed closely, the appearance of the packed jacket 1 is limited to a rectangle formation. Therefore, except for being packed, the convertible jacket 1 lacks a multi-function purpose.

SUMMARY OF THE INVENTION

It is therefore the purpose of this invention to provide a multi-function garment that is reconfigurable for a wearing function, a packing function, a neck pillow function, and other suitable functionalities.

The multi-function garment in accordance with the present invention comprises an article of clothing and a plurality of pockets disposed on the clothing. Each pocket includes an opening, a lining extended from a periphery of the opening, and a two-sided engaging unit at the opening and capable of being closed and opened. The lining is composed of an inner surface and an external surface opposite the inner surface. The inner surface is disposed inside the pocket to define a receptacle therein. The lining of one of the pockets includes a storage body of a ring-like configuration enclosed by the inner surface and the external surface. The storage body includes an external vacancy defined to be open to interrupt the ring-like configuration of the storage body, and an inner vacancy enclosed by the ring-like configuration of the storage body. One end of the inner vacancy is closed, and the other end of the inner vacancy communicates with the external vacancy. The inner surface of the lining is provided with a protecting layer. The inner vacancy is disposed near the opening of the pocket, and a dimension of the external vacancy is smaller than a dimension of the inner vacancy. A receiving room is formed by reversing the inner surface of the lining outward in order to accommodate the article of clothing so that the two-sided engaging unit is closed to wrap the article of clothing when the receiving room is stuffed with the article of clothing.

Preferably, a hanging rope is disposed on the lining.

Preferably, the protecting layer is disposed on the inner surface, corresponding to the external vacancy.

Preferably, a sensing unit is disposed on the article of clothing for detecting temperature, moisture, or other environmental data.

Preferably, an LED unit is disposed on the article of clothing.

Preferably, the protecting layer is formed by coating.

Preferably, the protecting layer is a waterproof and wear-resisting cloth attached to the inner surface.

Accordingly, the garment can be concisely packed and conveniently carried. Moreover, the appearance of the stuffed storage body can serve as a neck pillow that allows usage during traveling. As a result, the garment is multi-function.

DETAILED DESCRIPTION OF THE PREFERRED EMBODIMENTS

Figure 1:
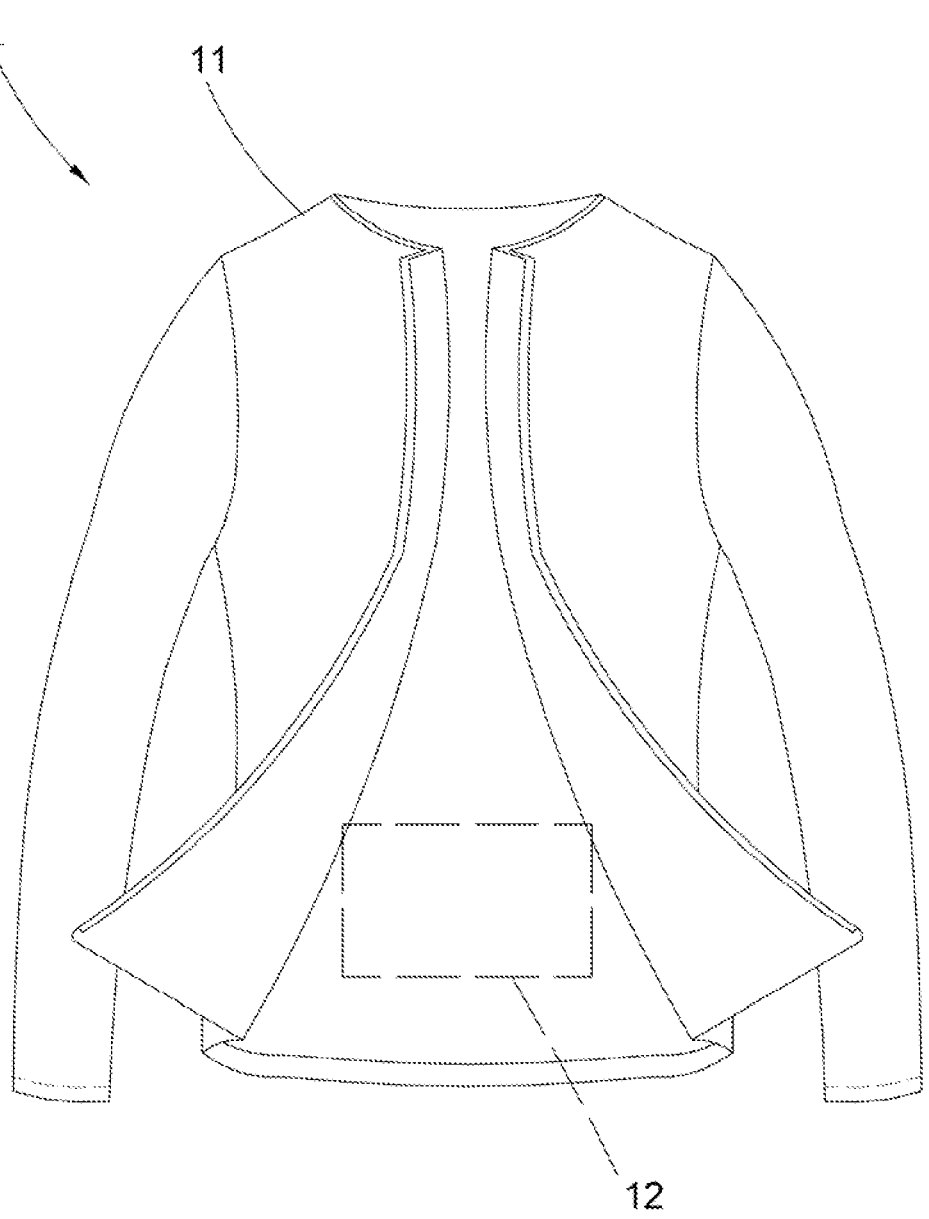
FIG. 1 (PRIOR ART)
FIG. 1 is a front view showing a conventional convertible jacket.
Figure 2:
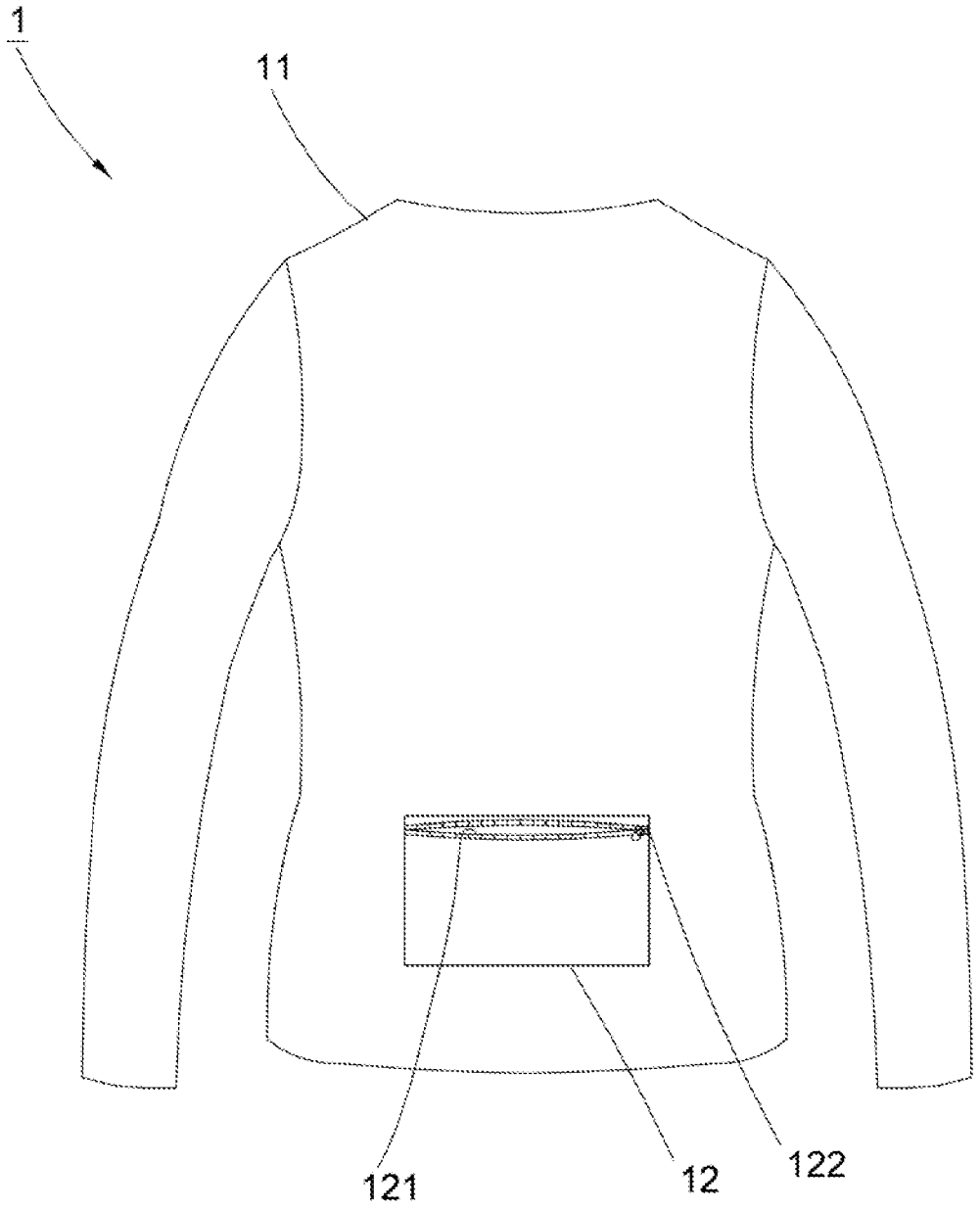
FIG. 2 (PRIOR ART)
FIG. 2 is a back view showing the conventional convertible jacket.

Wherever possible, the same reference numbers are used in the drawings and the description to refer to the same or like parts.

Figure 3:
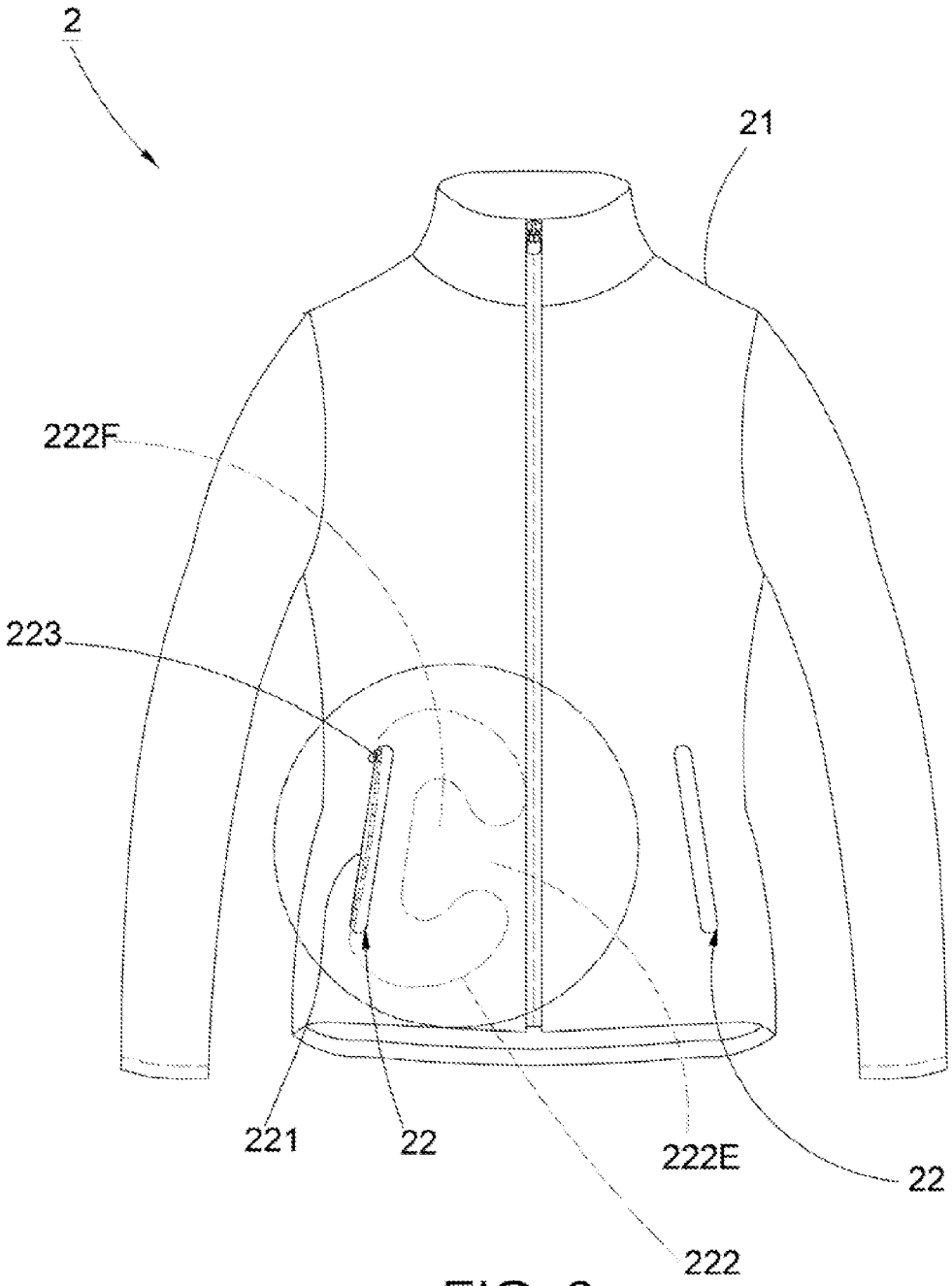
FIG. 3 is a schematic view of a first preferred embodiment of the present invention.
Figure 4:
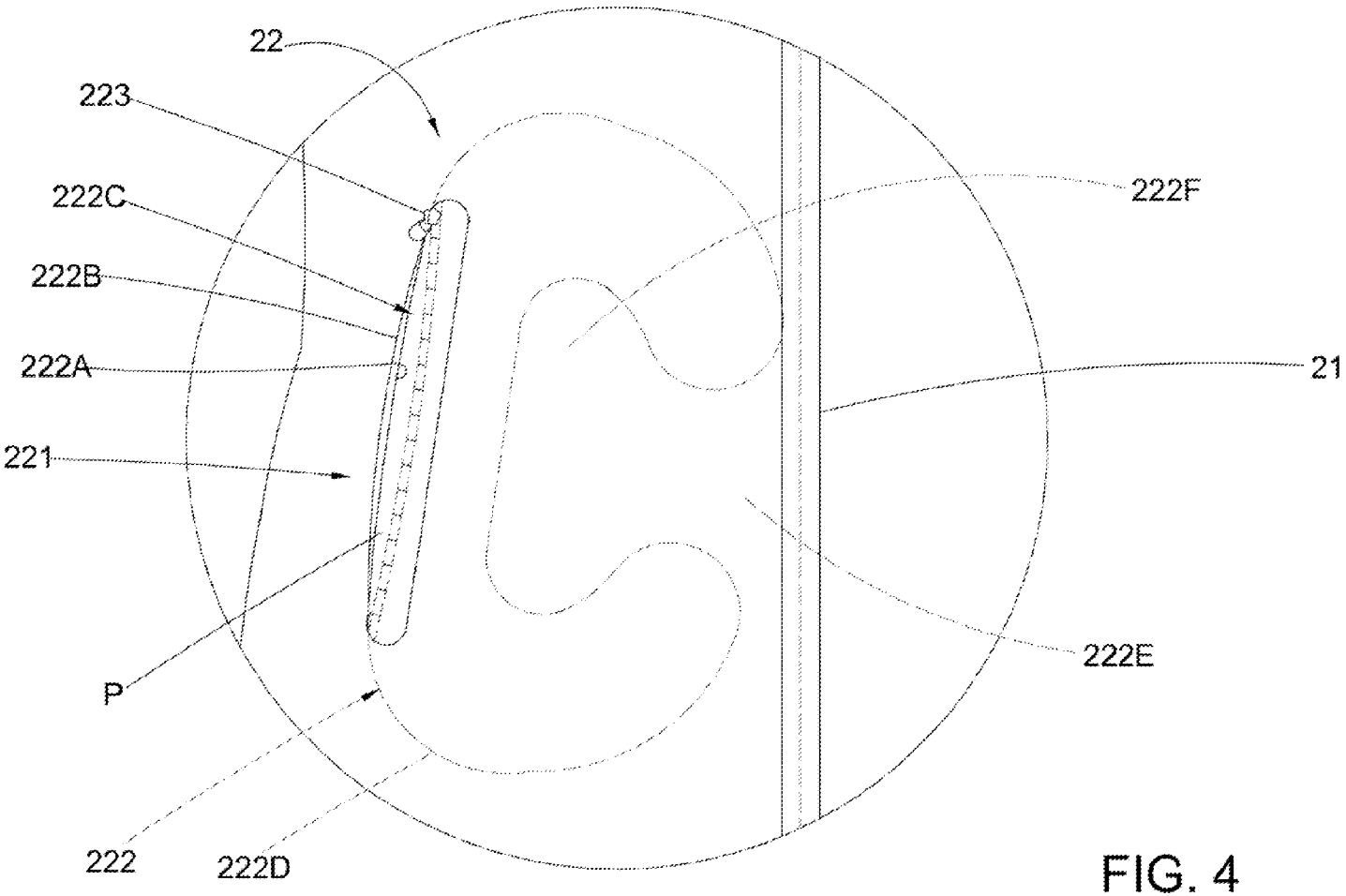
FIG. 4 is a partial, enlarged view of FIG. 3.
Figure 5:
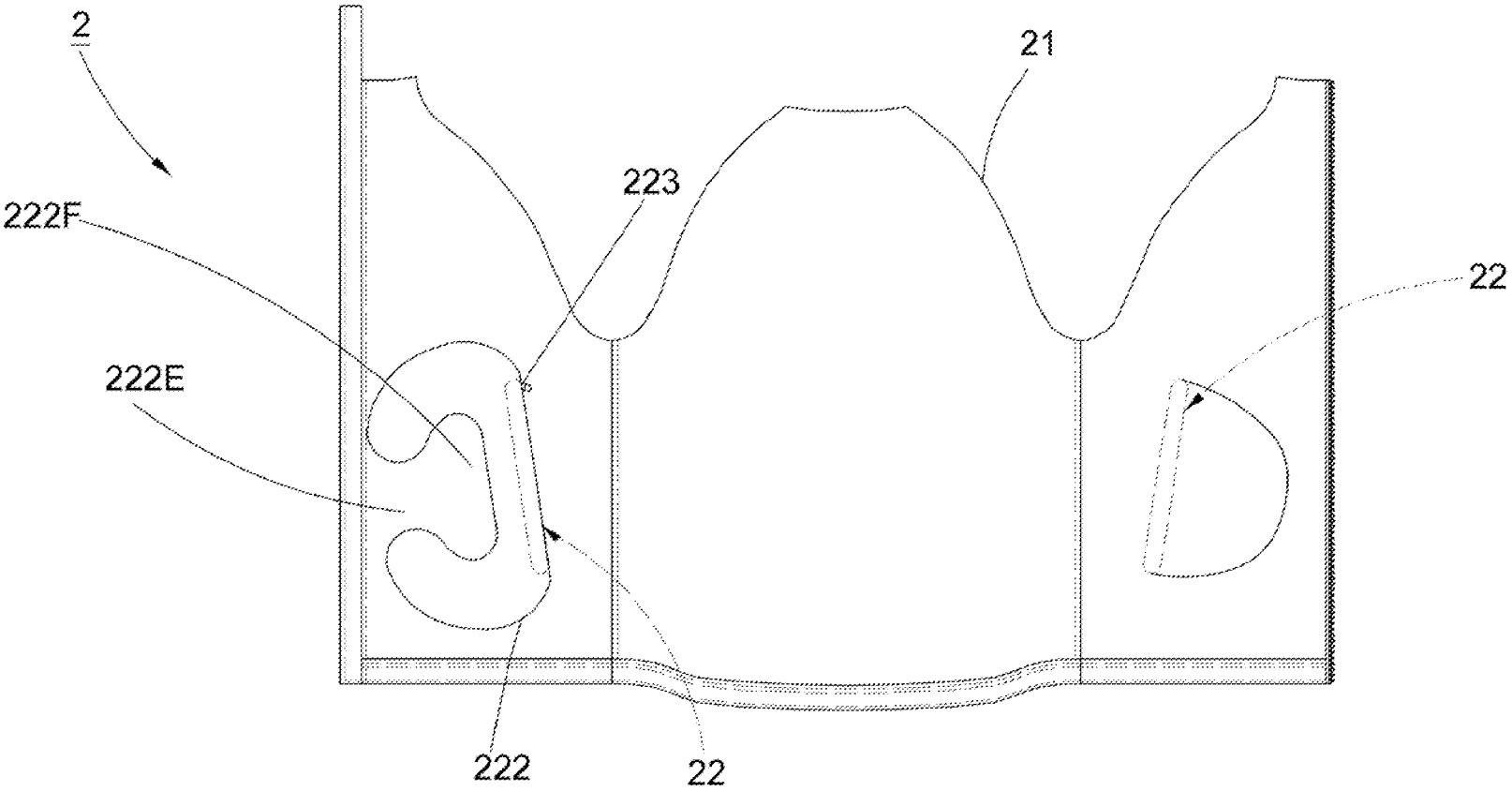
FIG. 5 is a further schematic view showing the first preferred embodiment of the present invention.

Referring to FIGS. 3 to 5, a first preferred embodiment of the present invention is shown. A multi-function garment 2 comprises an article of clothing 21 and a plurality of pockets 22 disposed on the article of clothing 21. Each pocket 22 includes an opening 221, a lining 222 extended from a periphery of the opening 221, and a two-sided engaging unit 223 at the opening 221 and capable of being closed and opened. The lining 222 is composed of an inner surface 222A and an external surface 222B disposed in accordance with the inner surface 222A. The inner surface 222A is disposed inside the pocket 22 to define a receptacle 222C therein. The pockets 22 on the article of clothing 21 are defined at a proper position for users to comfortably place their hands. Moreover, the two-sided engaging unit 223 can be a two-sided zipper, two-sided buckles, or two-sided hook and loop fasteners. In this embodiment, the two-sided engaging unit 223 is directed to the two-sided zipper.

Figure 6:
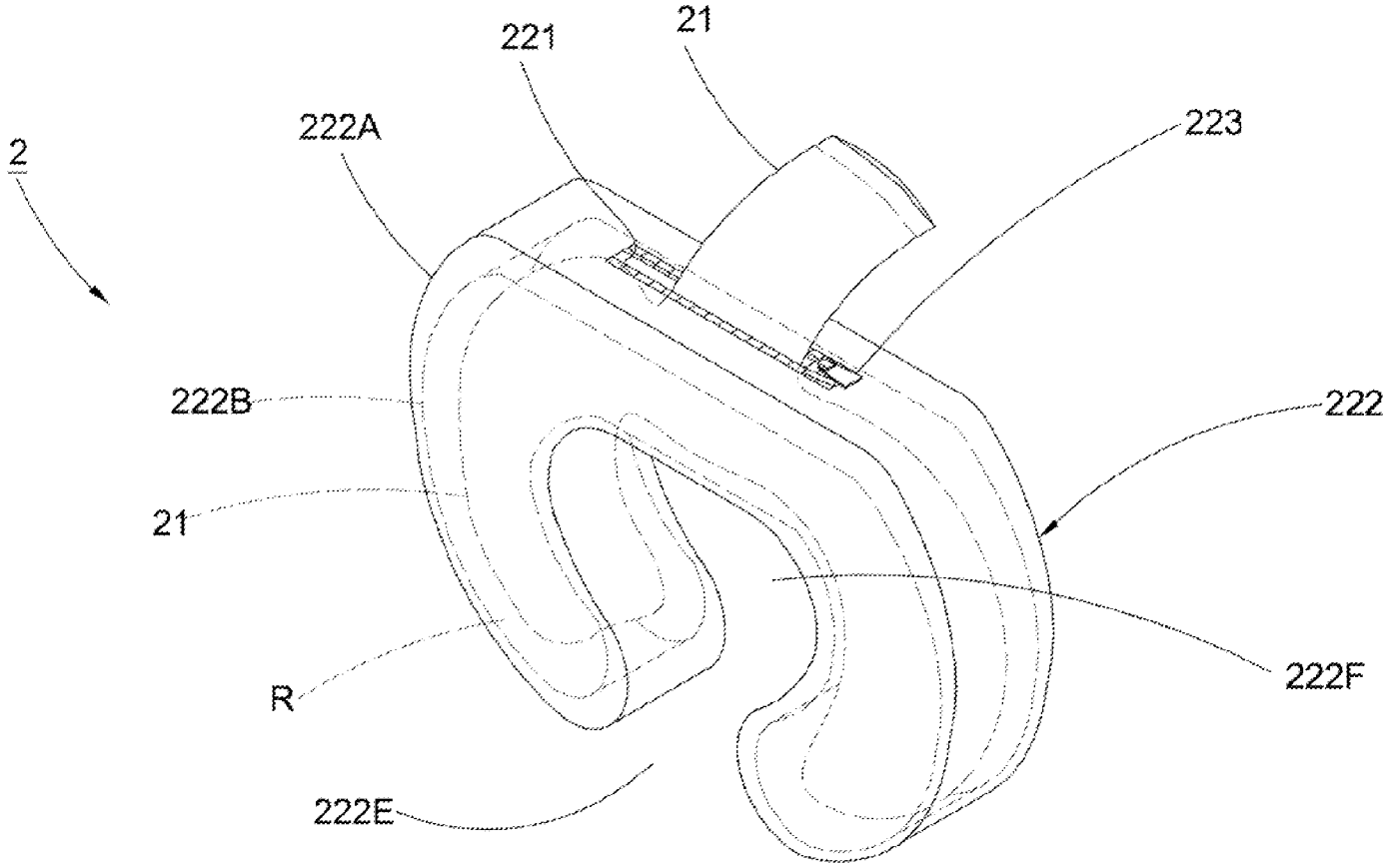
FIG. 6 is a schematic view showing that the first preferred embodiment of the present invention is received.

Specifically, the lining 222 of one of the pockets 22 includes a storage body 222D of a ring-like configuration enclosed by the inner surface 222A and the external surface 222B. The storage body 222D includes an external vacancy 222E defined to be open to interrupt the ring-like configuration of the storage body 222D, and an inner vacancy 222F enclosed by the ring-like configuration of the storage body 222D. One end of the inner vacancy 222F is closed, and the other end thereof communicates with the external vacancy 222E. The inner surface 222A of the lining 222 is provided with a protecting layer P. The inner vacancy 222F is disposed near the opening 221 of the pocket 22, and a dimension of the external vacancy 222E is smaller than a dimension of the inner vacancy 222F. A receiving room R is formed by reversing the inner surface 222A of the lining 222 outward in order to accommodate the article of clothing 21 (as shown in FIG. 6), so that the two-sided engaging unit 223 is closed to wrap the article of clothing 21 when the receiving room R is stuffed with the article of clothing 21. Thereby, a neck pillow is provided.

Referring to FIGS. 3 to 6, in using, users wear the article of clothing 21 for protecting their skin or keeping their body temperature. In addition, when the two-sided engaging unit 223 (zipper) around the periphery of the opening 221 is closed, articles placed in the receptacle 222C of each pocket 22 can be safely stored. Namely, the articles do not fall from the pocket 22. Alternatively, when the multi-function garment 2 is to be received, carried, or used for other purposes, the inner surface 222A is reversed via the opening 221, so that the receiving room R is contributed and the article of clothing 21 can be wrapped therein. Accordingly, when the article of clothing 21 is received in the receiving room R, a compact formation is provided for carrying. In fact, the storage body 222D of the lining 222 is structured as a ringlike configuration, and the dimension of the external vacancy 222E is smaller than the dimension of the inner vacancy 222F. Subsequently, the article of clothing 21 that is folded and the receiving room R that is stuffed with the article of clothing 21 contribute to a formation of the neck pillow including the larger inner vacancy 222F and the smaller external vacancy 222E. Thereby, users may put the neck pillow around their necks to support their necks while taking transportation during traveling. Consequently, it is not uncomfortable anymore during traveling, since users can take a nice rest. As a result, the compact structure of the present invention is advantageous to be carried, the formation of the stuffed storage body 222D can serve as a neck pillow, and the application of the multi-function garment is increased, which further promotes life quality.

Figure 7:
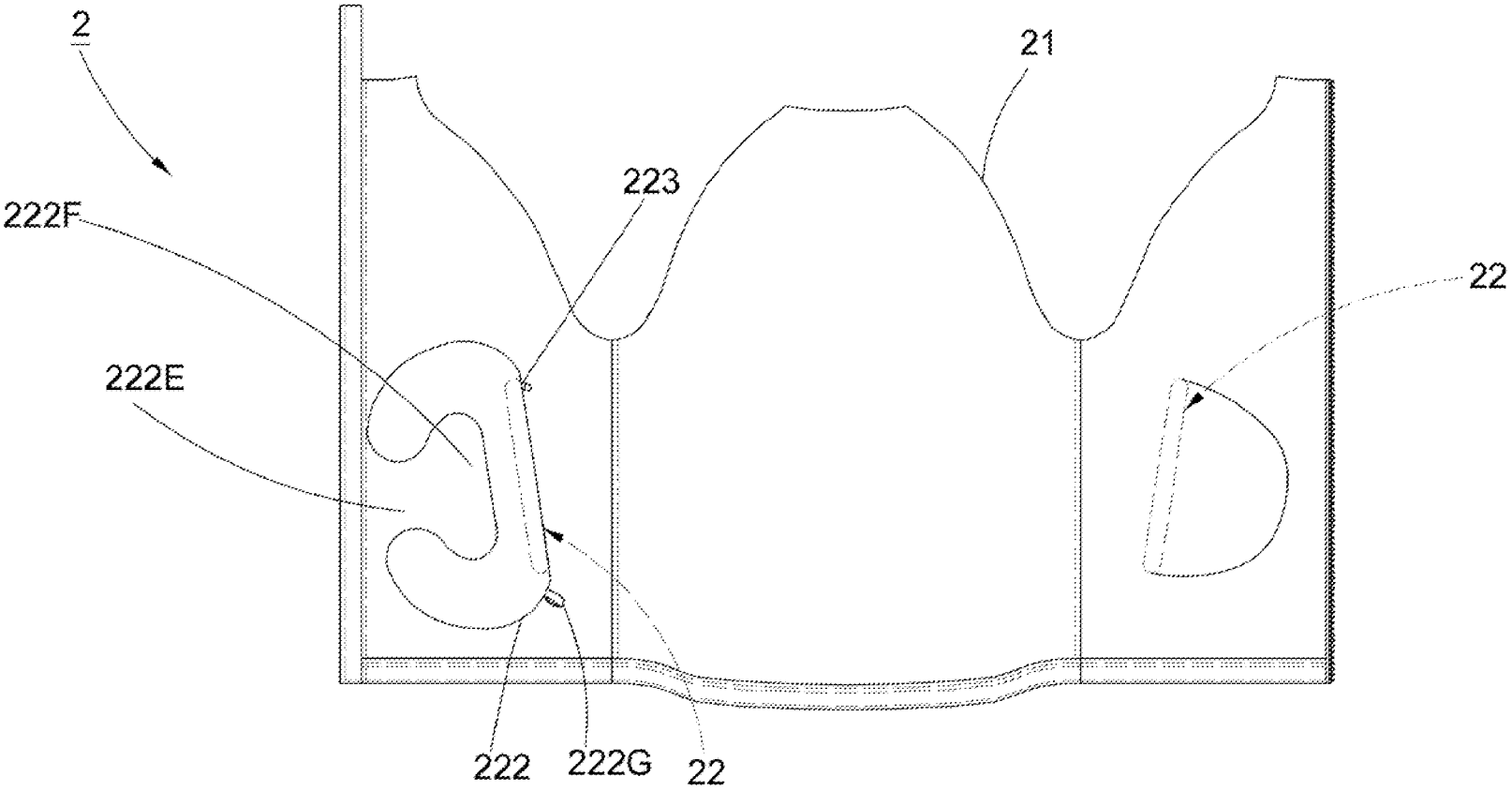
FIG. 7 is a schematic view showing a second preferred embodiment of the present invention.
Figure 8:
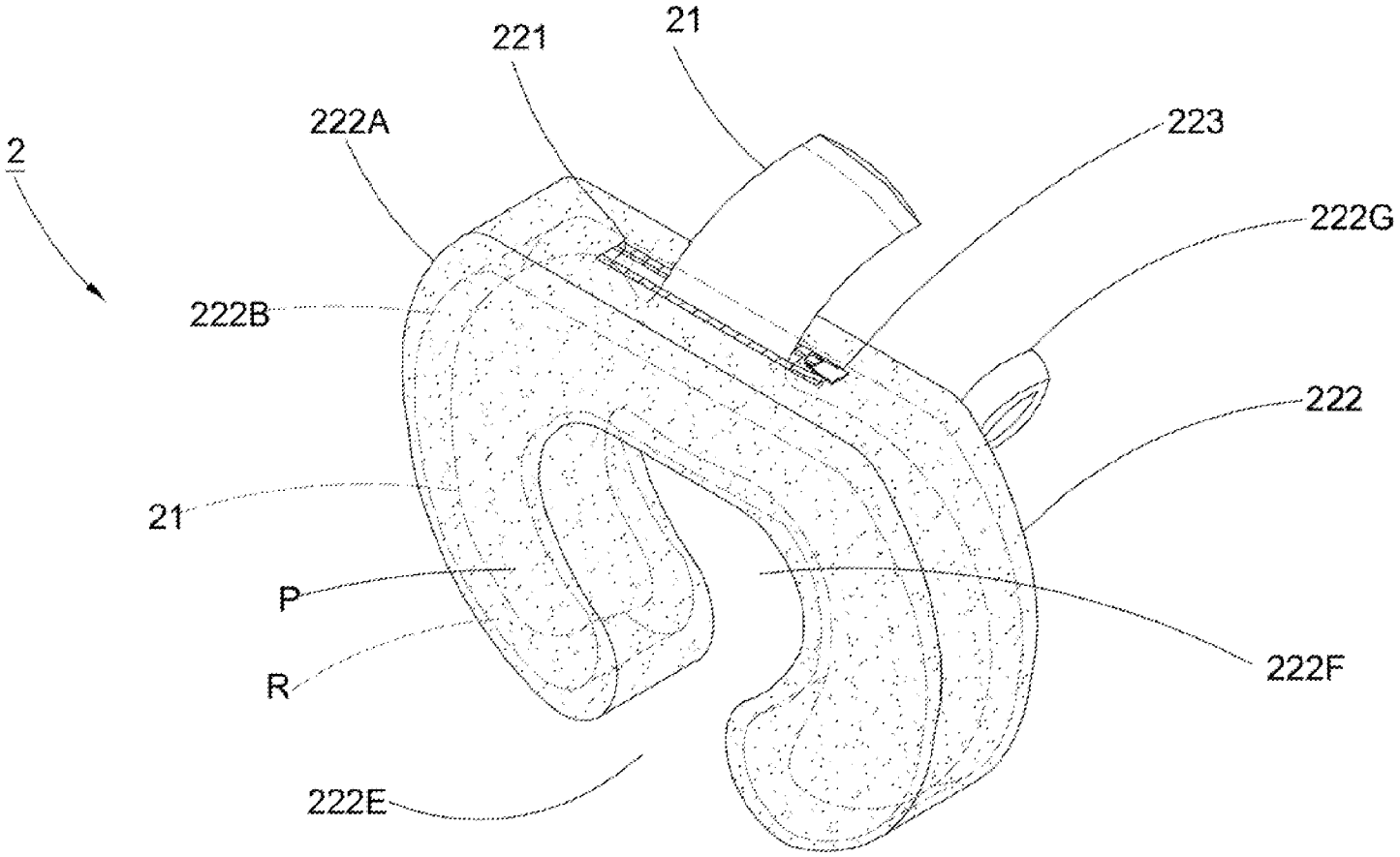
FIG. 8 is a schematic view showing that the second preferred embodiment of the present invention is received.
Figure 9:
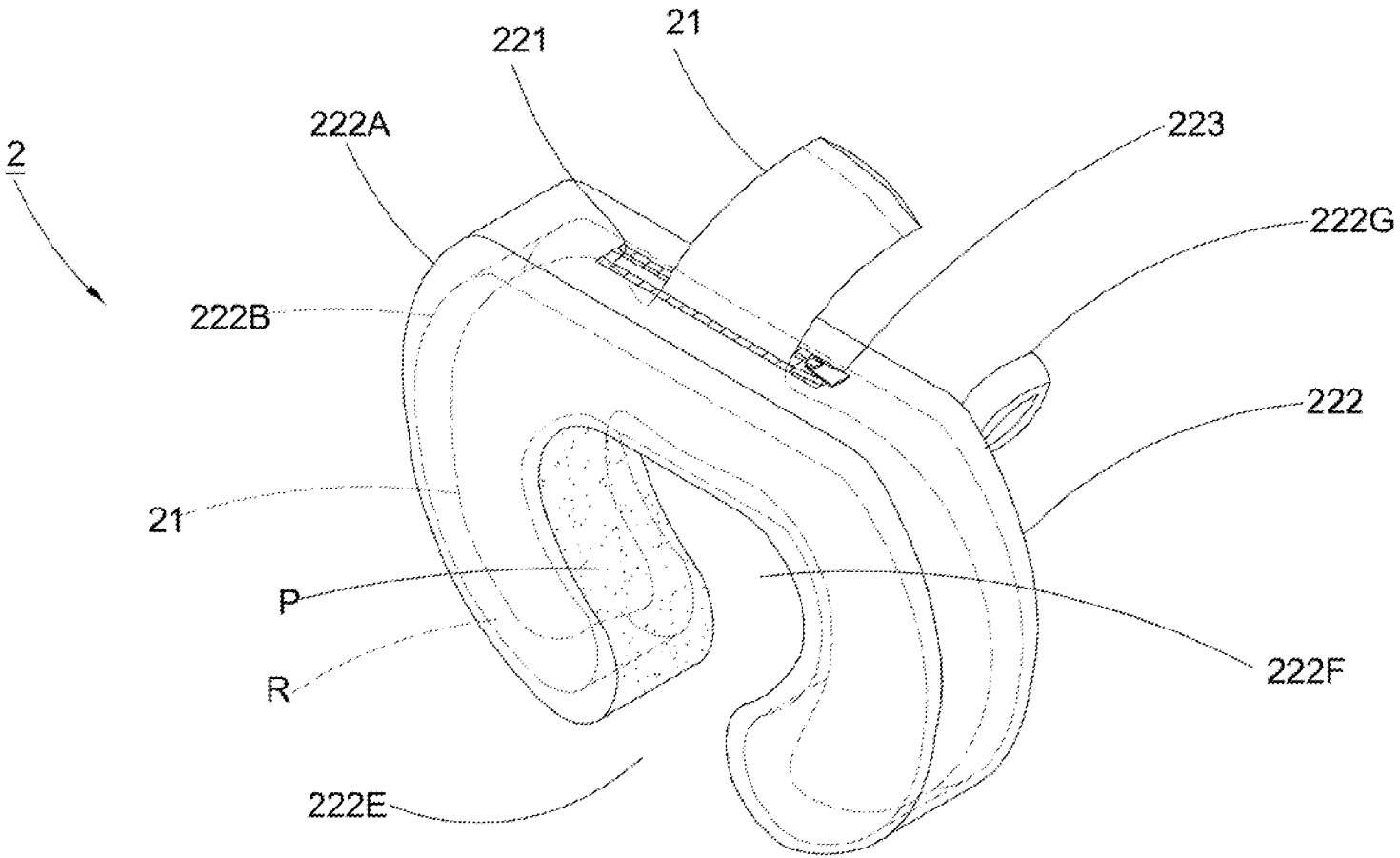
FIG. 9 is a schematic view showing that a third preferred embodiment of the present invention is received.

Referring to FIGS. 7 to 9, a further preferred embodiment of the present invention is shown. The multi-function garment 2 similarly comprises an article of clothing 21 and a plurality of pockets 22 disposed on the article of clothing 21. Differently, a hanging rope 222G is disposed on the lining 222. With the hanging rope 222G, the multi-function garment 2 that is received in the storage body 222D can be easily carried or hung. The protecting layer P is formed by coating$_s$ and the coating is thoroughly applied to the entire protecting layer P (as shown in FIG. 8). Namely, after the inner surface 222A of the lining 222 is turned over and stuffed with the article of clothing 21 for serving as a neck pillow, the users' worn garment (not shown) does not contact the inner surface 222A directly. Thereby, the users' worn garment is protected appropriately. Also, the protecting layer P is a waterproof and wear-resisting cloth attached to the inner surface 222A, corresponding to the external vacancy 222E (as shown in FIG. 9). In this figure, the protecting layer P adopts a visco-elastic material that is sensitive to the users' body temperature. Such material preferably memorizes users' necks to provide the necks optimum support. In fact, the protecting layer P can also adopt a material that can keep a cooler temperature or a warmer temperature. With this temperature keeping material, the neck pillow is able to assist users in adjusting body temperature or adapting to the environment. Accordingly, by the hanging rope 222G and the protecting layer P, users can use the garment of the present invention in accordance with their practical purposes. Therefore, the present invention is convenient for carrying and multi-function.

Figure 10:
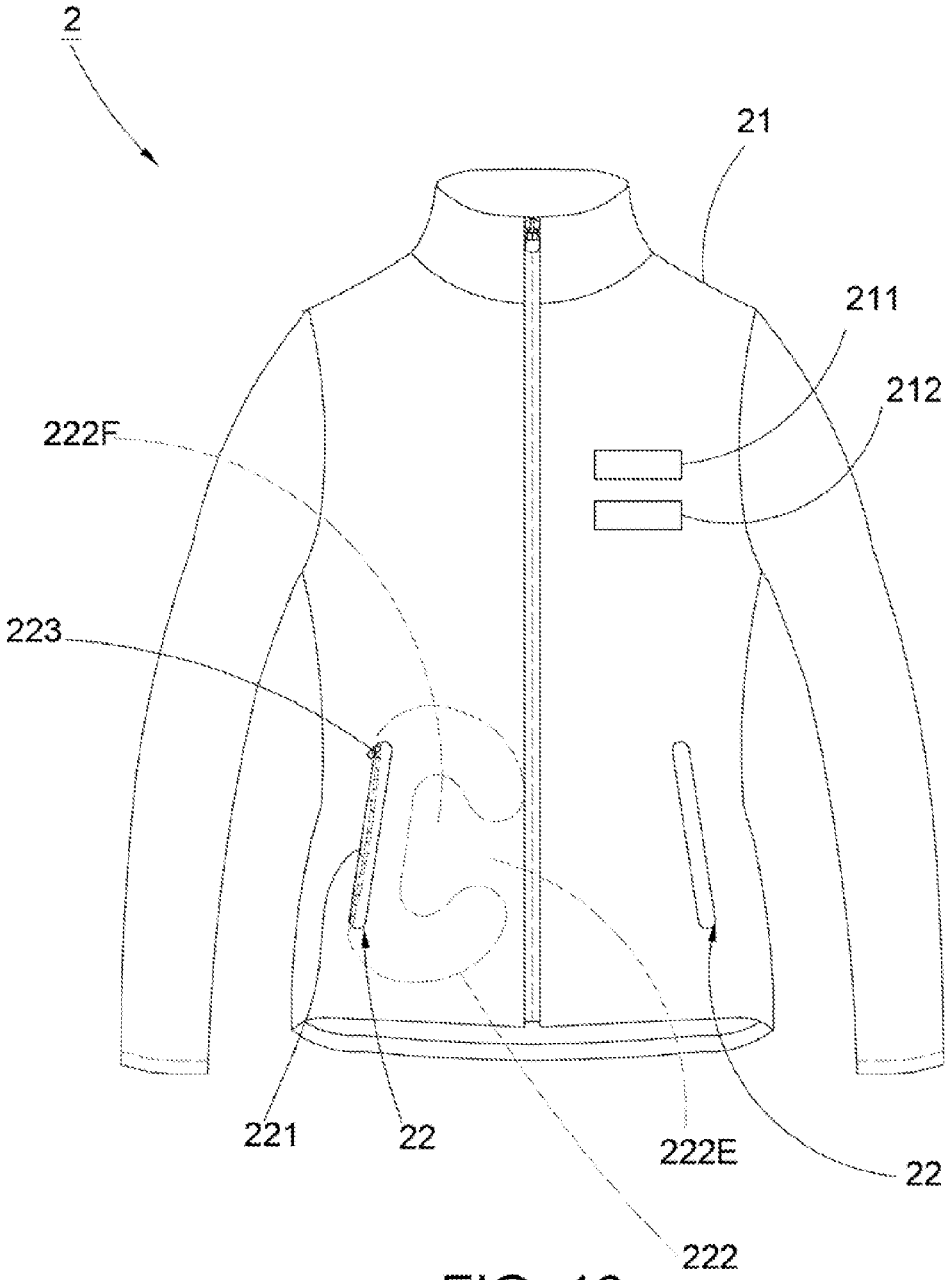
FIG. 10 is a schematic view showing a fourth preferred embodiment.

Accompanying with FIG. 10, a further preferred embodiment of the present invention is shown. The multi-function garment 2 similarly comprises an article of clothing 21 and a plurality of pockets 22 disposed on the article of clothing 21. Differently, a sensing unit 211 (shown by a sketch) is disposed on the article of clothing 21 for detecting temperature, moisture, or other environmental data. Also, an LED unit 212 (shown by a sketch) is concurrently disposed on the article of clothing 21. The LED unit 212 adapts users to any dark environment easily. Obviously, the structure of the present invention is more compact and convenient to be carried when the article of clothing 21 is received in the receiving room R. Favorably, the present invention achieves objects of multipurpose.

To sum up, the multi-function garment of the present invention can be worn as a jacket Moreover, when the article of clothing is reversed via the opening of one pocket and encircled in the receiving room of the storage body, the stuffed storage body is not only compact but also convenient to be carried. Additionally, a neck pillow is provided. Consequently, the present invention achieves multiple purposes and expands the usage of the multi-function garment.

While embodiments in accordance with the present invention have been shown and described, it should be clear to those skilled in the art that further embodiments may be made without departing from the scope of the present invention.

I claim:

1. A multi-function garment comprising an article of clothing and a plurality of pockets disposed on said article of clothing; with each pocket including an opening, a lining extended from a periphery of said opening, and a two-sided engaging unit at the opening and capable of being closed and opened; with said lining composed of an inner surface and an external surface opposite said inner surface; with said inner surface disposed inside said pocket to define a receptacle therein;

wherein said lining of one of said plurality of pockets includes a storage body of a ring-like configuration enclosed by said inner surface and said external surface, with said storage body including an external vacancy defined to be open to interrupt said ring-like configuration of said storage body and an inner vacancy enclosed by said ring-like configuration of said storage body, with one end of said inner vacancy closed and another end of the inner vacancy communicating with said external vacancy; with said inner surface of said lining provided with a protecting layer; with said inner vacancy disposed near said opening of said pocket, with a dimension of said external vacancy being smaller than a dimension of said inner vacancy; with a receiving room formed by reversing said inner surface of said lining outward in order to accommodate said article of clothing with said two-sided engaging unit closed to wrap said clothing when said receiving room is stuffed with said article of clothing.

2. The multi-function garment as claimed in claim 1, wherein a hanging rope is disposed on said lining adjacent said opening.

3. The multi-function garment as claimed in claim 1, wherein said protecting layer is disposed on said inner surface corresponding to said external vacancy.

4. The multi-function garment as claimed in claim 1, wherein a sensing unit is disposed on said article of clothing for detecting temperature, moisture, or other environmental data.

5. The multi-function garment as claimed in claim 1, wherein an LED unit is disposed on said article of clothing.

6. The multi-function garment as claimed in claim 1, wherein said protecting layer is formed by coating.

7. The multi-function garment as claimed in claim 3, wherein said protecting layer is formed by coating.

8. The multi-function garment as claimed in claim 1, wherein said protecting layer is a waterproof and wear-resisting cloth attached to said inner surface.

9. The multi-function garment as claimed in claim 3, wherein said protecting layer is a waterproof and wear-resisting cloth attached to said inner surface.

* * * * *